US012331634B2

(12) United States Patent
Chang et al.

(10) Patent No.: US 12,331,634 B2
(45) **Date of Patent: *Jun. 17, 2025**

(54) CALORIMETRIC CONTROL OF DOWNHOLE TOOLS

(71) Applicant: Halliburton Energy Services, Inc., Houston, TX (US)

(72) Inventors: Gabriel Yun Chong Chang, Singapore (SG); Timothy Simmonds, Singapore (SG); Gavin Munro, Singapore (SG); Peter Reid Maher, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/625,037

(22) Filed: Apr. 2, 2024

(65) Prior Publication Data

US 2024/0247585 A1 Jul. 25, 2024

Related U.S. Application Data

(63) Continuation of application No. 17/984,713, filed on Nov. 10, 2022, now Pat. No. 11,976,550.

(51) Int. Cl.
*E21B 47/12* (2012.01)
*E21B 23/00* (2006.01)
(Continued)

(52) U.S. Cl.
CPC ..... *E21B 47/12* (2013.01); *E21B 23/00* (2013.01); *E21B 33/12* (2013.01); *E21B 34/06* (2013.01);
(Continued)

(58) Field of Classification Search
CPC ..... E21B 47/12; E21B 34/066
See application file for complete search history.

(56) References Cited

U.S. PATENT DOCUMENTS 4,414,441 A 11/1983 Perry et al.
5,226,333 A 7/1993 Hess
(Continued)

FOREIGN PATENT DOCUMENTS

BR 112013032100 B1 11/2020
EP 1161615 10/2004
(Continued)

OTHER PUBLICATIONS

International Search Report and Written Opinion for International Patent Application No. PCT/US2022/051385 dated Jul. 26, 2023.

*Primary Examiner* — Kipp C Wallace
(74) *Attorney, Agent, or Firm* — Scott Richardson; C. Tumey Law Group PLLC

(57) ABSTRACT

Systems and methods are disclosed for controlling a downhole tool by encoding a tool control signal in a fluid flow and obtaining a temperature response downhole. In an example, a system for controlling a downhole tool includes a signal transmitter, a signal receiver, and a controller. The signal transmitter is uphole of the tool to be controlled (e.g., at surface) and encodes the tool control signal by varying one or more fluid flow parameters of a fluid flow down a well. The signal receiver is positionable in the well in fluid communication with the fluid flow. The signal receiver detects a temperature response in the fluid flow resulting from varying the one or more fluid flow parameters. A controller controls the downhole tool according to the temperature response.

19 Claims, 5 Drawing Sheets

(51) Int. Cl.

| | |
|---|---|
| ***E21B 33/12*** | (2006.01) |
| ***E21B 34/06*** | (2006.01) |
| ***E21B 36/00*** | (2006.01) |
| ***E21B 47/07*** | (2012.01) |
| ***E21B 47/103*** | (2012.01) |
| ***E21B 47/18*** | (2012.01) |

(52) U.S. Cl.
CPC ..... *E21B 36/00* (2013.01); *E21B 47/07* (2020.05); *E21B 47/103* (2020.05); *E21B 47/18* (2013.01)

(56) References Cited

U.S. PATENT DOCUMENTS

| | | | |
|---|---|---|---|
| 7,246,662 | B2 | 7/2007 | Jabusch et al. |
| 7,424,366 | B2 | 9/2008 | Angelescu et al. |
| 7,890,273 | B2 | 2/2011 | Lovell et al. |
| 10,132,159 | B2 | 11/2018 | Burgos |
| 10,309,814 | B2 | 6/2019 | Moscato et al. |
| 10,393,919 | B2 | 8/2019 | Adil et al. |
| 11,035,203 | B2 | 6/2021 | Merron et al. |
| 11,092,000 | B2 | 8/2021 | Jarvis et al. |
| 11,473,398 | B1 | 10/2022 | Jones et al. |
| 2003/0015319 | A1 | 1/2003 | Green et al. |
| 2004/0256113 | A1 | 12/2004 | LoGiudice et al. |
| 2006/0131014 | A1 | 6/2006 | Huang et al. |
| 2006/0185900 | A1 | 8/2006 | Jones et al. |
| 2007/0272410 | A1* | 11/2007 | Hromas ..... E21B 43/116 166/55 |
| 2012/0061095 | A1 | 3/2012 | Capderou |
| 2013/0020097 | A1 | 1/2013 | Veneruso et al. |
| 2013/0269951 | A1 | 10/2013 | Tahoun et al. |
| 2014/0118157 | A1 | 5/2014 | Jamison |
| 2014/0157884 | A1 | 6/2014 | Adil et al. |
| 2019/0136674 | A1 | 5/2019 | Fripp et al. |
| 2019/0249549 | A1 | 8/2019 | Fripp et al. |

FOREIGN PATENT DOCUMENTS

| | | | |
|---|---|---|---|
| WO | 2001065066 | A1 | 9/2001 |
| WO | 2014190252 | | 11/2014 |
| WO | 2019217301 | A1 | 11/2019 |

* cited by examiner

CALORIMETRIC CONTROL OF DOWNHOLE TOOLS

CROSS-REFERENCE TO RELATED APPLICATIONS

This is a continuation of U.S. application Ser. No. 17/984,713, filed Nov. 10, 2022, which is a nonprovisional application, the entire disclosure of which is incorporated herein by reference.

BACKGROUND

The activation of downhole tools is commonly achieved by workstring movement, hydraulic pressure, mechanical shifting or with the use of balls, darts or other devices passed through the ID of the workstring. Use of hydraulic pressure requires isolation of the workstring from the annulus or formation. This is also commonly achieved by the use of balls, darts or other plugging devices. The dependency on these devices restricts the internal diameters of the tools in the workstring and imposes limitations on the sizes and numbers of such devices that can be used in a single trip. The use of balls and darts also increases rig time, introduces operational risks and challenges with high well deviation. Furthermore, if a tool needs to be activated multiple times in single trip, the use of balls or darts may limit the number of activation cycles before it is necessary for the tool to be tripped out of hole.

BRIEF DESCRIPTION OF THE DRAWINGS

These drawings illustrate certain aspects of some of the embodiments of the present disclosure and should not be used to limit or define the method.

DETAILED DESCRIPTION

The present disclosure relates to controlling downhole tools using signals encoded in fluid flow and interpreted via calorimetry. The fluid flow may be generated at the surface of a well site and directed down the well to the tool to be controlled. A tool control signal is encoded in a fluid flow down a well by varying one or more fluid flow parameters that will affect heat transfer at one or more sensor locations downhole. For example, a flow rate may be modulated at the surface based on the tool control signal using any of a variety of encoding schemes. Alternatively, the heat transfer is varied by changing other fluid flow parameters such as the composition of the fluid flow or the turbulence of the fluid flow. The fluid flow parameter(s) is/are varied in a way that causes changes in heat transfer that are detectable downhole using any of a variety of calorimetric flow sensor configurations. In particular, a temperature response due to the heat transfer may be detected at one or more temperature sensing locations downhole resulting from varying the one or more fluid flow parameters. The tool control signal is thereby interpreted according to the resulting temperature response and the downhole tool is controlled accordingly. In this way, the tool can be controlled without the use of balls, darts or other plugging devices, and may be activated multiple times in single trip. The tool control signal can also be encoded in fluids such as cement that are not suitable for conventional fluid pulse telemetry techniques. A finite number of example configurations are disclosed embodying different combinations of features, though other configurations may be constructed having any suitable combination of disclosed features.

Figure 1:
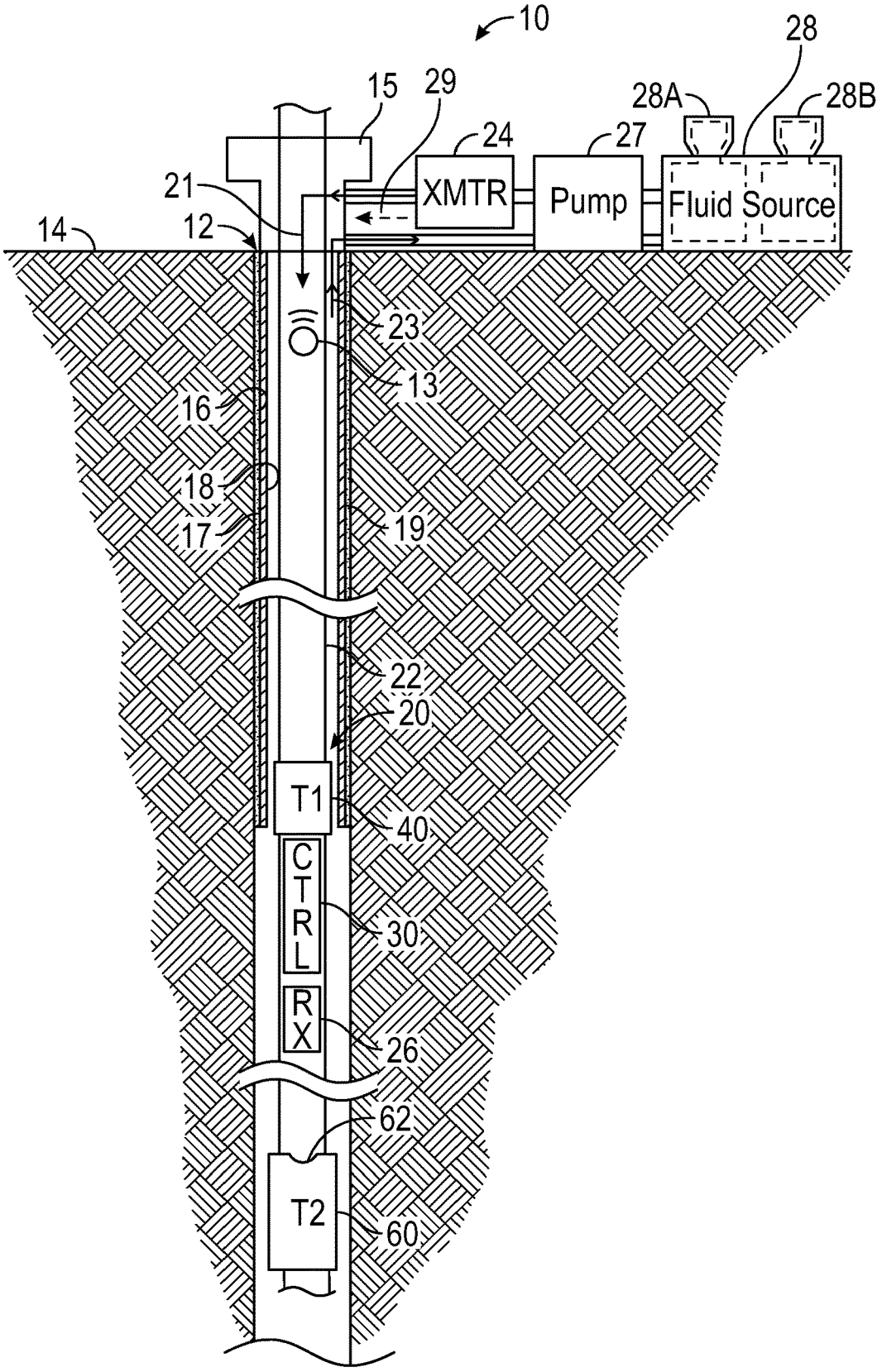
FIG. 1 is an elevation view of a representative well site at which a system and method may be implemented for controlling a downhole tool.

FIG. 1 is an elevation view of a representative well site 10 at which a system and method may be implemented for controlling a downhole tool 40. Aspects of the figure are schematically illustrated and not to scale. A well 12 is drilled to any given depth below a surface 14 of the well site 10. The surface 14 may represent the ground level of a land-based drilling operation or the seabed of a subsea drilling operation, for example. The well 12 comprises a wellbore 16 extending from the surface 14 to any depth in an effort to reach a hydrocarbon bearing formation located below ground. The wellbore 16 may be lined to some depth with a casing 18, which is a tubular structure such as ferrous metal or composite material that structurally reinforces the wellbore 16. The casing 18 may be cemented in place by circulating a cement 17 into an annular space between the casing 18 and the wellbore 16 and allowing the cement 17 to cure.

A variety of tool strings are used to work on a well throughout its life, including during the drilling, completion, and production phases, for workover operations and maintenance, and to shut in or repurpose a well at the end of its service life. A representative tool string 20 is provided in FIG. 1 that includes a tubular conveyance 22, such as drill pipe, with various downhole tools and other equipment supported thereon. The tool string 20 is suspended in the well 12 from a support structure 15 (e.g., a wellhead) at the surface 14. The tool string 20 may sealingly extend through the support structure 15 to support and contain fluid pressure in the well 12. A fluid flow may be generated at the surface 14 (i.e., above ground) such as with a fluid source 28 coupled to a pump 27. The fluid flow 21 may be directed downhole through the tool string 20 and up an annulus 19 between the tool string 20 and the wellbore 16 or casing 18. In some operations a return flow 23 may be circulated back to surface equipment, such as a filtration system (not shown).

Fluids are circulated downhole during many kinds of wellbore operations. For example, during the completion phase of the well 12, cement 17 may be circulated down an appropriate tool string for cementing the casing 18 to the wellbore 16. In another example, pressurized stimulation fluids, such as acidizing or hydraulic fracturing fluids, may be circulated downhole through an appropriate tool string for enhancing production. Pressurized fluid may also be circulated downhole during hydraulic workover operations. Various tools in the tool string 20, i.e., downhole tools, may be operated using fluid flow and/or to help control the fluid flow during wellbore operations. Two tools are shown by way of example, although any number of downhole tools and tool configurations are possible using the principles of this disclosure.

The downhole tool 40 ("T1") is actuated according to aspects of this disclosure using encoded tool control signals. A system for controlling the downhole tool 40 comprises a transmitter ("XMTR") 24 for encoding a tool control signal into the fluid flow 21. The signal transmitter 24 may be located at the surface 14 and used to encode the tool control signal by varying one or more fluid flow parameters of the fluid flow 21 in relation to the tool control signal. For example, the transmitter 24 may include flow control elements such as a variable valve, e.g., a choke or variable flow orifice, to modulate the flow rate of fluid flow 21 from the pump 27 according to the tool control signal to be encoded. Thus, modulating a flow rate is an example of varying a fluid flow parameter to encode the tool control signal in the fluid flow 21.

The fluid source 28 in the system may also include a plurality of fluid components, e.g., at least two fluid components 23A, 23B, having different fluid compositions. The tool control signal in some embodiments may be encoded, at least in part, by varying a fluid composition of the fluid flow 21. Varying the fluid composition of the fluid flow 21 varies a thermal conductivity of the fluid flow 21 and corresponding heat transfer downhole even without varying the flow rate. For example, the transmitter 24 may be used to dynamically switch between the two fluid components 23A, 23B or dynamically adjust a ratio of the fluid components 23A/23B in relation to the tool control signal to produce a time-varying heat transfer detectable downhole using calorimetry.

Thus, varying the fluid flow rate and varying the fluid composition are two examples of varying a fluid flow parameter to encode the tool control signal in the fluid flow 21 in a way that is detectable downhole using calorimetry. In one or more embodiments, the tool control signal may be encoded just by varying the flow rate. In one or more embodiments, the tool control signal may instead be encoded just by varying the fluid composition. In one or more embodiments, the tool control signal may be encoded both by varying the flow rate and the fluid composition, such as to achieve a wider range of detectable heat transfer and corresponding signal bandwidth. In still other embodiments, any other fluid flow parameters may be varied in a way that is detectable downhole using calorimetry.

The system also includes a downhole receiver ("RX") 26 positioned in the well in fluid communication with the fluid flow 21. The signal receiver 26 may comprise a calorimetric flow sensor that detects a temperature variation in the fluid flow resulting from varying the one or more fluid flow parameters at the transmitter 24. A controller 30 is in communication with the receiver 26 for controlling the downhole tool 40 based on the detected temperature response. For example, the receiver 26 may use calorimetry to obtain a time-varying temperature response resulting from the varying fluid flow parameters of the fluid flow 21 as it passes through the receiver 26. The time-varying temperature response may be interpreted by the controller 30 as a digital or analog signal (based on the encoding scheme), since the temperature response is expected to vary in relation to the modulation of the fluid flow parameters. The controller 30 then controls the downhole tool 40 in relation to the temperature response. Any number of additional tools (not shown) may be included in the tool string 20 controlled by calorimetry, which may be individually addressed by the tool control signal 29.

The tool string 20 may also include one or more other tools controlled in other ways, i.e., without necessarily encoding or interpreting a signal using calorimetry. For example, a second downhole tool 60 ("T2") positioned downstream of the first downhole tool 40 may be operated by dropping a plugging member 13 into the well 12. The plugging member 13 may comprise a ball or dart, for example, that seats within a schematically-drawn ball seat 62 to close or reduce flow through the second downhole tool 60. The second downhole tool 60 may be a tool that is used after the downhole tool 40 has completed any number of cycles, in a wellbore operation that requires performing one or more repetitions of a first function with the downhole tool 40 followed by a second function with the second downhole tool 60. Desirably, since the first downhole tool 40 is not operated using a plugging member, its flow bore remains unobstructed for the plugging member 13 to pass through the first downhole tool 40 and further down the tool string 20 to the second downhole tool 60.

Figure 2:
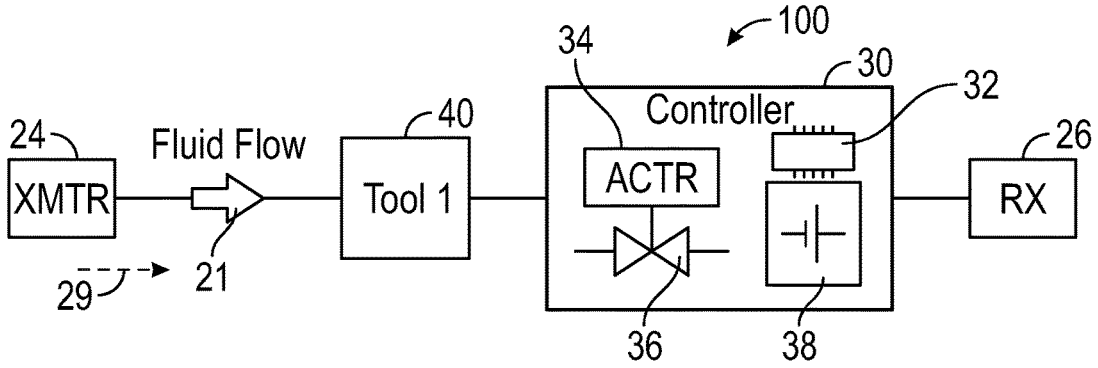
FIG. 2 is a schematic diagram of a system for controlling the downhole tool.

FIG. 2 is a schematic diagram of a system 100 for controlling the downhole tool 40. The system 100 comprises components discussed in the context of the well site of FIG. 1 and provides additional details according to example configurations. The system 100 therefore includes the transmitter 24, the receiver 26, the downhole tool 40, and the controller 30. These system components may be incorporated into any of a variety of tool strings in which remote tool control is desired for wellbore operations. The system 100 provides for tool control and communication in systems where electronic communication media (e.g., wired pipe) is unavailable or cost prohibitive. The system 100 also provides for tool control and communication where even conventional fluid pulse telemetry is not practical. For example, in a cementing operation, the fluid is cement, which is generally too viscous and high-pressure for using mud pulse telemetry techniques of the kind used during drilling when a much lighter viscosity and lower pressure drilling mud is used as the fluid.

Various controller components are illustrated for controlling the downhole tool 40 in response to the tool control signal 29. These controller components are illustrated as separate components for ease of discussion, but may contain overlapping functionality, or additional components or subcomponents that perform the control functionality as it is schematically described in FIG. 2. The controller 30 includes control logic 32 used to control operation of the downhole tool 40, such as for interpreting the tool control signal 29 based on the temperature response from the receiver 26 and for controlling the downhole tool 40 accordingly. The control logic 32 may comprise computer useable data and instructions, such as software and/or firmware embodied on any suitable memory format including but not limited to random access memory (RAM) and/or random operating memory (ROM). The controller 30 further includes an actuator 34 for controlling the downhole tool 40 based on the tool control signal 29. The controller 30 also include a downhole power source 38 for operating the electronics comprising the control logic 32, the actuator 34, and other components requiring downhole power. The power source 38 may comprise an on-board battery or electrical power lead from another downhole component, such as from a wireline connection or downhole power generator.

Thus, the downhole tool 40 may be controlled in response to the tool control signal 29. In some configurations, the actuator 34 may be directly coupled to the downhole tool 40, to open, close, shift, rotate, or otherwise mechanically operate the downhole tool 40. Alternatively, the actuator 34 may be coupled to a variable flow restrictor 36, such as a valve or choke, to indirectly control the first downhole tool by adjusting the flow restriction to the downhole tool 40 in response to the tool control signal 29. The variable flow restrictor 36 may be advantageous, for example, where mechanically operating the downhole tool 40 requires more force or power than the actuator 34 or power source 38 can directly provide, particularly with finite power available from the power source 38 (e.g. on-board battery). In that case, it can be more efficient or effective for the actuator 34 to perform a lower-power operation such as adjusting flow using the variable flow restrictor 36, and to use the pressurized flow resulting from that change to mechanically operate the downhole tool 40.

The system 100 may be used for any of a variety of tool control needs in a variety of wellbore operations. Examples include setting and unsetting of packers; opening, closing, and/or choking valves and sleeves, formation isolation or choking, hydraulic fracturing, work string connect and disconnect, swivel activation and deactivation; activation of drilling and wellbore cleaning tools (e.g., brushes, scrapers, and mills); operating tools requiring unlimited activation and deactivation cycles in a single trip; and tandem equipment runs where advanced control of specific tools are required. The system 100 could also be used in production flow, in which surface choke can be used to control flow rates downhole and initiate system response.

Figure 3A:
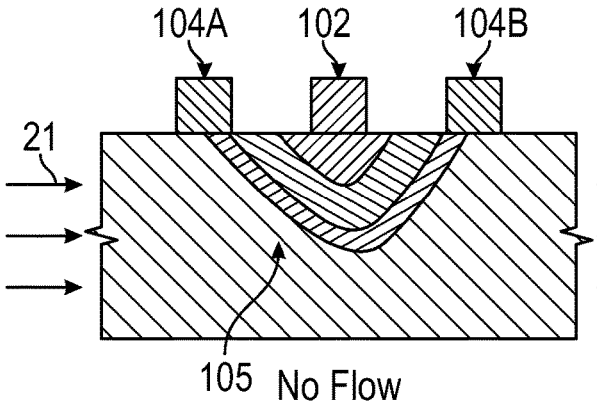
FIG. 3A is a schematic illustrations of a baseline thermal gradient with two temperature sensors prior to initiating flow.
Figure 3B:
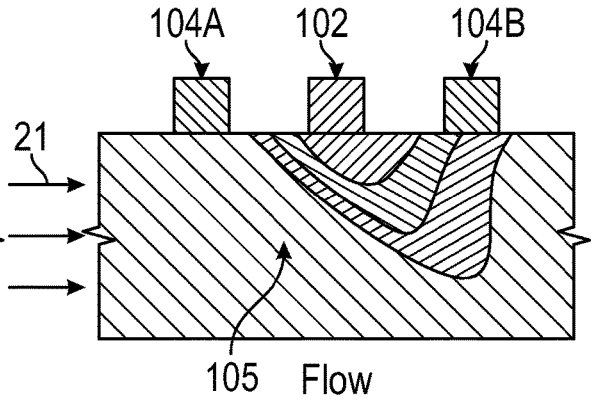
FIG. 3B is a schematic illustrations of a temperature response after flow is initiated.

A myriad of systems can be constructed using different configurations of a heating element and any number of temperature sensors. In some cases, as few as one temperature sensor can be used to obtain a temperature response. FIGS. 3A and 3B are schematic illustrations of a calorimetric sensor configuration for obtaining a temperature differential with two temperature sensors. In particular, FIG. 3A is a schematic illustrations of a baseline thermal gradient with two temperature sensors prior to initiating flow. FIG. 3B is a schematic illustrations of a temperature response after flow is initiated.

A first temperature sensor 104A is positioned at a first temperature sensing location upstream of a heating element 102. A second temperature sensor 104B is positioned at a second temperature sensing location downstream of the heating element 102. With this configuration, a temperature differential may be obtained between the first temperature sensor 104A and the second temperature sensor 104B as an indication of flow rate. The flow rate may be varied over time so that the temperature differential varies over time. The variation of time is useful for generating a signal, such as a digital signal encoded as a series of 0s and 1s, or an analog signal based on a time-varying value.

In FIG. 3A, the flow rate is zero or nearly zero. Thus, a thermal gradient or distribution 105 is relatively uniform and symmetrical about the heating element 102, with the highest temperatures nearest the heating element 102 below and on either side of the heating element 102. In FIG. 3B, the fluid flow is now moving downhole (to the right in this figure), which skews the temperature distribution toward the right of the heating element 102. The second temperature sensor 104B should detect hotter temperatures than the first temperature sensor 104A. The temperatures measured at each temperature sensing location will vary over time after something is changed, such as increasing temperature of the heating element 102 or varying a flow parameter such as the flow rate. This temperature response is dependent, at least in part, on variable flow parameters, and can be analyzed to interpret a tool control signal encoded by modulating one or more flow parameters.

Figure 4:
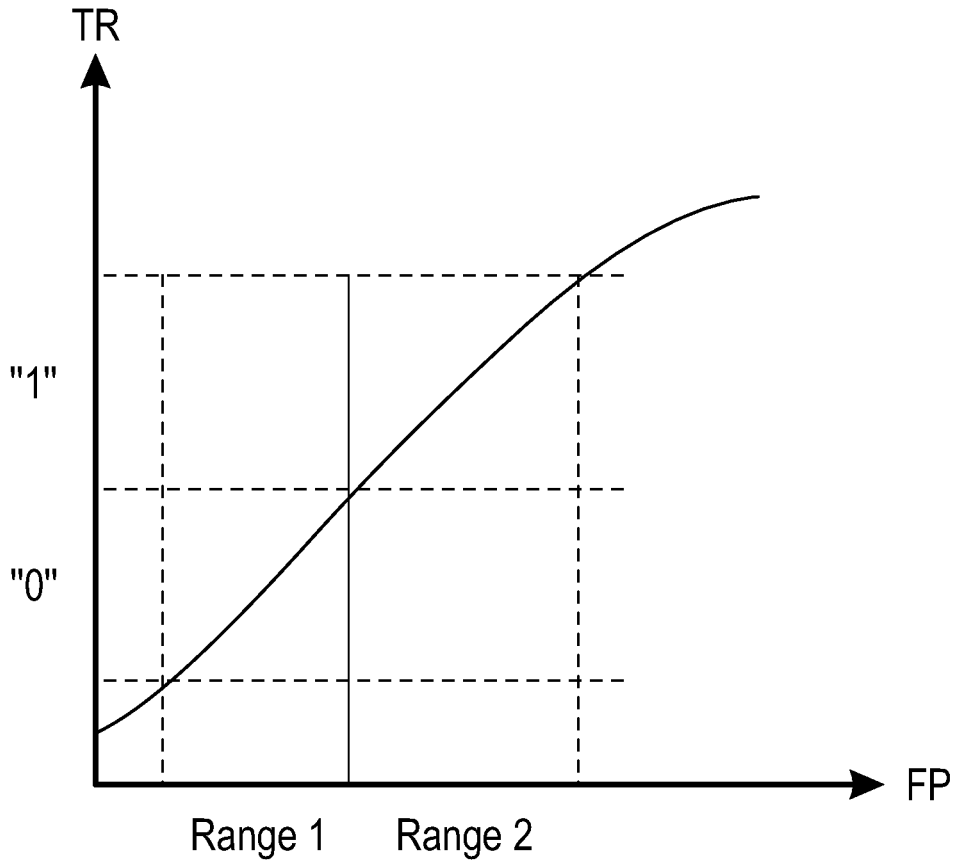
FIG. 4 is a graphical representation of an example correlation between a variable fluid flow parameter "FP" with a time-varying temperature response.

FIG. 4 is a graphical representation of an example correlation relating a variable fluid flow parameter "FP" (horizontal axis) with a time-varying temperature response (vertical axis). The fluid flow parameter on the horizontal axis may be any variable parameter of the fluid flow that is detectable downhole using calorimetry. The fluid flow parameter may be, for example, a flow rate or a rate of change of the flow rate. Alternatively, the fluid flow parameter may comprise a fluid composition ratio or a turbulence. The time-varying temperature response plotted on the vertical axis represents some temperature response that may occur downhole as a result of modulating the fluid flow parameter. The temperature response may be detected using a calorimetric sensor. A signal may be encoded by varying the fluid flow parameter over time. The time-varying temperature response may be encoded as a tool control signal used to control a downhole tool.

Any suitable encoding method may be used. By way of illustration, FIG. 4 is an example useful for a binary encoding, whereby a first range of values of temperature response may be assigned a binary "0" value and a second range of values of temperature response may be assigned a binary "1" value. The "0" value in the temperature response corresponds to a first range (Range 1) of fluid parameter while the "1" value in the temperature response corresponds to a second range (Range 2) of fluid parameter. Range 1 and Range 2 may be non-overlapping, so that a temperature response is clearly in one or the other of the two ranges. Thus, the tool control signal may be encoded by varying the fluid flow parameters as a pattern of resulting 0s and 1s in the temperature response. This or other applicable correlation may be stored in memory such as in the receiver or controller described in FIG. 2. A downhole tool may be controlled according to the temperature response. Per the correlation of FIG. 4, for example, a temperature response somewhere in Range 1 may be interpreted as a binary "0" and a temperature response somewhere in Range 2 may be interpreted as a binary "1." The fluid parameters may be varied to achieve a binary pattern of 0s and 1s representative of the signal to be communicated.

The tool control signal may be interpreted based on the temperature response without necessarily decoding the tool control signal. For example, in at least some embodiments, it is not necessary to back-calculate the original value of the fluid parameter on the horizontal axis. As in the example of FIG. 4, the binary 0 and the binary 1 may be based on the temperature response without explicitly obtaining the original value of the fluid parameter on the horizontal axis. However, in some configurations, the tool control signal could be decoded by measuring the temperature response (vertical axis) and applying the correlation to back-calculate the corresponding flow parameter values (horizontal axis) and using the back-calculated flow parameter values to control the downhole tool. Alternatively, the flow parameter values may be back-calculated as a check or confirmation to validate the tool control signal. For example, a back-calculated flow parameter value outside an expected range could be used to generate an error or flag, such as the need to repair or re-calibrate one or more components of the system.

FIG. 4 thus serves as a non-limiting example of a correlation used to encode and optionally decode a tool control signal. Any of a variety of signal encoding and decoding methodologies may be used. In one or more embodiments, the tool control signal may be encoded using pulse positioning or differential pulse positioning. In some examples, the encoding can be based on a length of time that the flow is held at the flow rate or at the patterns of changes in flow rate. The signal may be digital or analog. A digital encoding can include an address for different locations in the tool string corresponding to different tools, as well as a command for each of the respective locations. The digital command may be used to command an action from a downhole tool that the tool is capable of implementing. In some cases, the action may be to toggle the tool ON/OFF. In other cases, the action may be to implement some setting, where a range of settings are available, or to implement one or more actions other than ON/OFF.

The action of the downhole tool can be, for example, to change the flow restriction such as through the deployment of a flapper, a ball valve, a sliding sleeve, a needle valve, a packer element, or any mechanism that can restrict the flow. In some cases, the action may be performed by one tool or tool component in response to the tool control signal in a way that will cause a corresponding function of another tool or tool component. For example, a valve may be closed at one location in the tool string in response to the tool control signal, which may results in the activation of a tool at a second point due to the increased pressure from the flow. An increased flow rate may result in a higher activation pressure. In such applications, the tool at one location can be deactivated by removing the flow restriction at another location. The flow restriction at one location can be deactivated either by an elapsed time or by receiving a digital command from the surface such as through a predetermined sequence of different heat transfer. Some commands may be time based. For example, after an initial activation of a tool or tool component, a countdown may be performed according to a predetermined time interval before deactivating. Separate commands may also be used to perform different functions, such as to open the valve and then to close the valve, or to go to an intermediate restriction. The valve can be actuated with a motor, a solenoid, a hydraulic chamber, an air chamber, etc.

Figure 5:
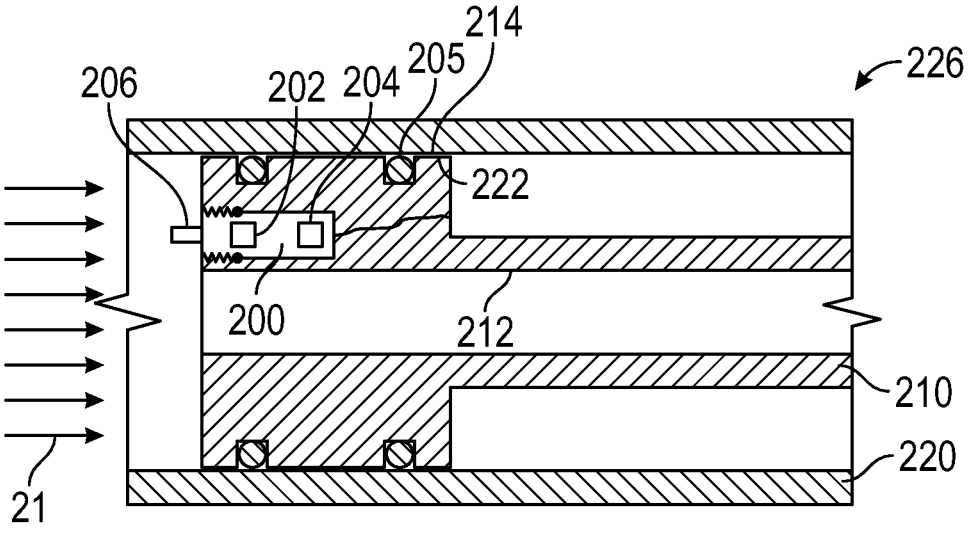
FIG. 5 is a sectional side view of a downhole receiver according to an example configuration comprising a calorimetric sensor assembled in an insert inside of an oilfield tubular.

FIG. 5 is a sectional side view of the downhole receiver 226 according to an example configuration comprising a calorimetric sensor 200 assembled in an insert 210 inside of an oilfield tubular 220. The oilfield tubular 220 may be a tubing string, tubular conveyance, drill collar, or other tubular component of a tubing string positionable downhole. The insert 210 has a generally tubular body, with an outer diameter (OD) 214 that fits inside an inner diameter (ID) 222 of the oilfield tubular 220. One or more sealing elements 205, such as O-rings, may be used to seal between the insert 210 and the oilfield tubular 220. In the context of a system such as in FIGS. 1 and 2, the calorimetric sensor may function as part of a downhole receiver that may detect variations in heat transfer resulting from varying the fluid flow parameters at surface. The calorimetric sensor 200 may be an axially-oriented calorimetric heat flow sensor assembled in the insert 210 inside of the oilfield tubular 220. The insert 210 is thus in-line with the oilfield tubular 220, so that a fluid flow 21 is constrained to pass through a flow bore 212 of the insert 210. The flow rate of the fluid flow 21 may be on the order of, for example, 7-9 BPM (barrels per minute).

The calorimetric sensor 200 may comprise one or more heating element 202 and one or more temperature sensors 204. The heating element 202 and temperature sensor 204 are schematically shown in the figure to represent any of a variety of sensor configurations, examples of which are mentioned below. The sensors 202, 204 may at least partially reside inside a probe 206. Generally, the heating element 202 may heat the fluid flow, and varying the fluid flow parameters produces a time-varying temperature response that may be detected using the one or more temperature sensors 204.

In a first example, the one or more temperature sensors 204 include a first temperature sensor used as a reference temperature sensor as a control feedback for the heating element 202. A second temperature sensor is a variable temperature sensor and is placed away from the heating element 201. Typically, the reference temperature sensor is upstream and the variable temperature sensor is downstream of the heating element (see, e.g., FIG. 6). The flow rate may be indicated by the difference in the temperature between the reference sensor and the variable sensor.

A second example may use a single temperature sensor 204 and a single heating element 202. The flow rate is indicated by the absolute temperature measured by the single temperature sensor 204. If the temperature sensor is upstream of the heating element, but still close enough for heat transfer to occur from the heating element to the upstream temperature sensor, then higher temperatures indicate lower flow rates. Conversely, if the temperature sensor is downstream of the heating element, then higher temperatures indicate higher flow rates, at least up to a certain threshold flow rate. If the flow rate were to exceed the threshold flow rate then the temperature at the downstream sensor would start to decrease again.

In a third example, the heating element 202 also functions as the temperature sensor 204. The internal resistance of the heater will vary with temperature. With a consistent power being delivered to the heating element, its temperature will vary with flow rate. At low flow rate, the heating element will get hotter than at higher flow rate. As it gets hotter, it will exhibit greater internal resistance which would be directly measured.

In a fourth example, the heating element 202 is collocated with the temperature sensor 204. As the heater/thermometer element is cooled by increased flow, the electronics can measure the variation with temperature and applied electrical power. The electronics can maintain a consistent temperature and measure the changes in the applied power to the heater that is necessary to maintain that consistent temperature. The electronics can maintain a consistent power to the heater and measure the changes in the resulting temperature. Thus, the third and fourth embodiments are similar in some respects, but with at least a difference in the configuration of the thermometer.

The heating element 202 has the option of either being constantly heated or being periodically heated above ambient temperature. When there is fluid flowing past the sensor probe, heat will be carried away from the heating element 202. Each time when the heating element needs to heat up, it would require current which is supplied by the power supply (chemical battery, wireline connection, or downhole power generator).

Due to different thermal conductivity of different fluids, it may be difficult to predict the exact flow rate. A user may calibrate each fluid used downhole and pre-program the data into the downhole tools to be controlled. Another way is to use the rate of current drawn by the heating element and only use low flow rate or high flow rate as "0" and "1" for communication from surface to downhole tools. Another encoding uses the changes in flow rate as the digital signal rather than the absolute flow rate. In some encoding a pulse position encoding is used. In other embodiments, the digital command is encoded in the rate of change of the flow rate, the time over which the flow changes, the time over which the flow is constant, the relative flow rates at different times, or combinations thereof.

Figure 6A:
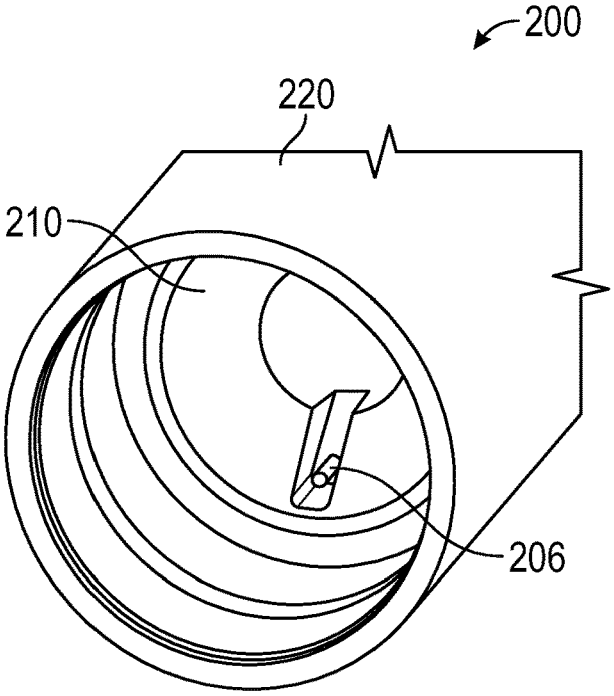
FIG. 6A is a perspective view of an example configuration of an insert disposed in the oilfield tubular.
Figure 6B:
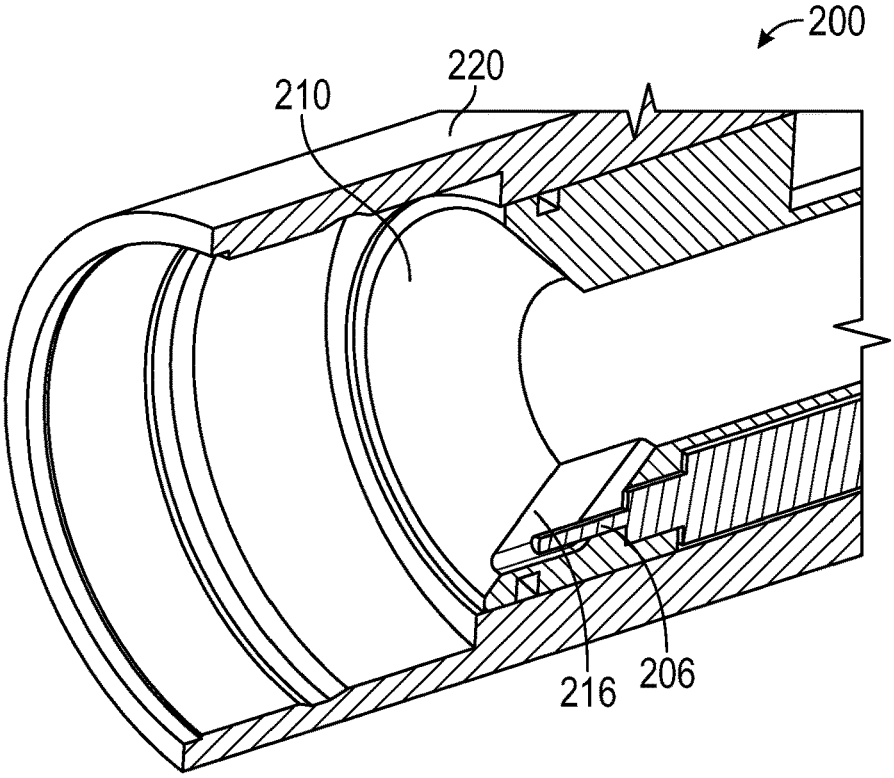
FIG. 6B is a partially cut-away perspective view of the insert of FIG. 6A.

In the examples disclosed herein, the probe does not necessarily need to be at the center of the insert, and may be positioned to avoid interfering with the ball or dart operation required for other downhole tools. For instance, FIG. 6A is a perspective view of an example configuration of the insert 210 as disposed in the oilfield tubular 220. FIG. 6B is a partially cut-away perspective view of the insert 210 and oilfield tubular 220 of FIG. 6A. The insert 210 may be assembled into the oilfield tubular 220 by insertion into the oilfield tubular 220. A portion (e.g., the electronics) of the calorimetric flow sensor 200 are embedded inside the insert 210 for protection. At least the probe 206 of the calorimetric flow sensor is exposed so that fluid flow into the flow bore 212 will flow over the probe 206 as it enters the insert 210. However, the probe 206 is recessed and protected by an undercut 216 in the insert 210. This reduces the chance of debris or cement sticking to or damaging the probe 206. The fluid circulation during operation would also serve as a way to clean the probe 206.

Figure 7:
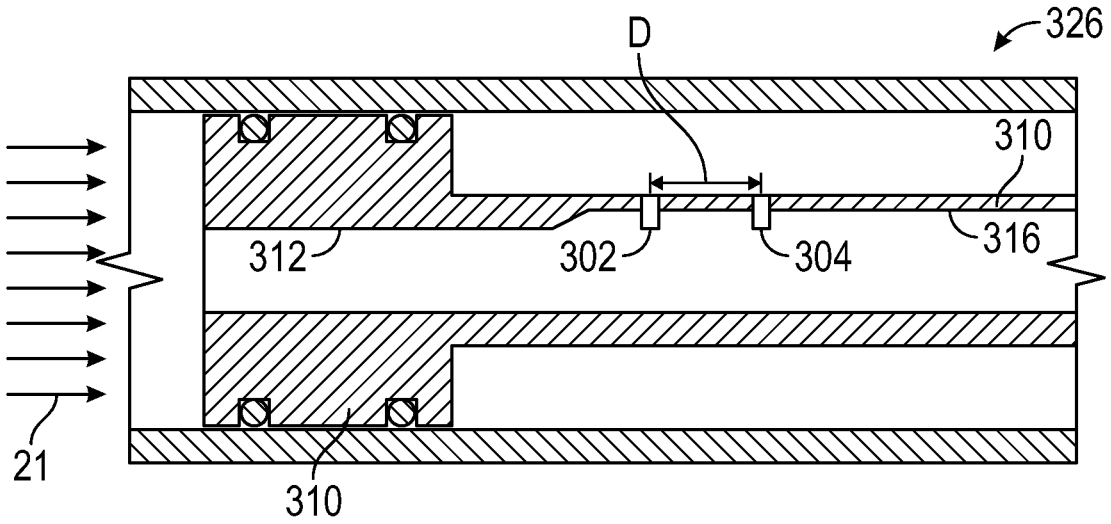
FIG. 7 is a sectional side view of the downhole receiver according to an example configuration comprising one temperature sensor at a single location downstream of a heating element.

FIG. 7 is a sectional side view of the downhole receiver 326 according to an example configuration comprising as few as one temperature sensor 304 at a single location downstream of a heating element 302. In this example, a time-varying temperature response may be obtained at the single temperature sensing location using the temperature sensor 304. The heating element 302 and single temperature sensor 304 are spaced along the fluid flow 21 at a distance "D" between the heating element 302 and temperature sensor 304. The heating element 302 may be controlled to selectively heat the fluid flow 21. When the heating element 302 is heated to a temperature greater than the fluid flow upstream of the heating element 302, the fluid flow 21 will be heated as it passes over the heating element 302. The downstream temperature sensor 304 will detect the resulting temperature response.

Dynamically varying the fluid flow parameters affects the temperature response. For example, varying the fluid flow rate will affect the alacrity of the temperature response (e.g., a steeper slope). Generally, increasing the flow rate will result in a faster temperature increase at the downstream sensor 304, and vice-versa. Also, cycling the heating element 302 off will result in a subsequent cooling downstream that is also detectable as a temperature response. The velocity of flow may be determined based on the rate of temperature change and the known distance D. Similarly, varying the fluid composition will affect the thermal conductivity and corresponding temperature response. Varying the fluid composition to increase thermal conductivity will generally result in faster temperature increases downstream, and vice-versa.

Other embodiments may employ additional temperature sensors downstream to measure a heat wave moving downhole. This may provide more complete information about the temperature response, or may provide more granularity for encoding the tool control signal, for example.

FIG. 7 also has an alternative insert 310 configuration comprising an annular groove 316 machined into the insert 310 downstream of a main flow bore 312 of the insert 310. The annular groove 316 has a larger diameter than the main flow bore 312. The heating element 302 and temperature sensor 304 are placed within this annular groove 316. The annular groove 316 thus helps protect the heating element 302 and temperature sensor 304, such as from large particles in the fluid flow 21. The annular groove 316 also allows a plugging member such as a ball or dart to pass through, providing clearance to allow the ball debris or cement to easily flow through without being obstructed by the sensors. The increased flow area allows for a significant variation in heat transfer into the fluid.

Figure 8:
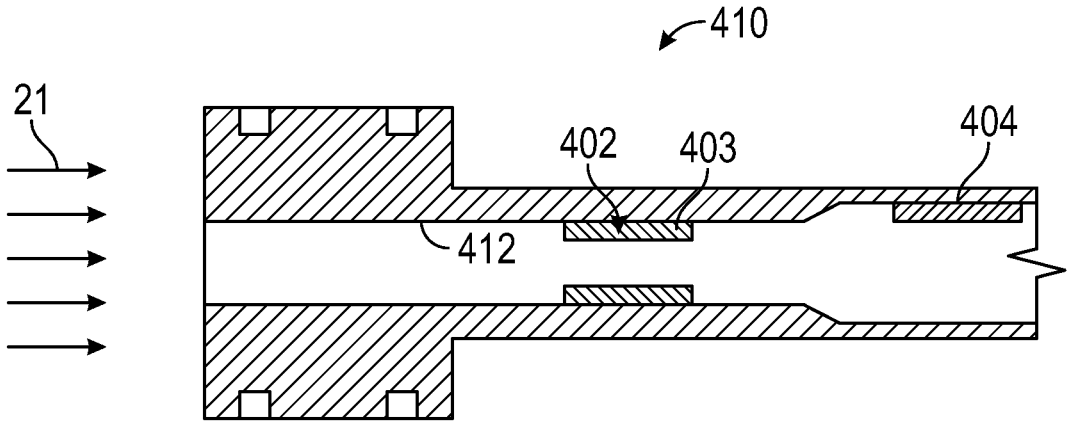
FIG. 8 is a side view of another embodiment of an insert, wherein the heating element comprises a circular plate.

FIG. 8 is a side view of another embodiment of an insert 410, wherein the heating element 402 comprises a circular plate 403. The temperature sensor 404 can be attached at a distance away from the heating element 402. The circular plate type heating element 402 can be secured in thermal proximity to the main flow bore of the insert 410, either on the ID 412 or, as shown, embedded within and flush with the ID 412 so as not to impinge on the flow. An advantage of this is that the heating element 402 is directed at the main flow and its circular, low profile allows a plugging member to pass through easily.

Accordingly, the present disclosure may provide systems and methods for controlling a downhole tool by varying fluid flow parameters to encode a tool control signal and using calorimetry to detect a temperature response corresponding to the tool control signal. The systems and methods may include any of the various features disclosed herein, in any suitable combination, including one or more of the following examples.

Example 1

A method of controlling a downhole tool, comprising: encoding a tool control signal in a fluid flow down a well by varying one or more fluid flow parameters of the fluid flow; obtaining a temperature response downhole resulting from varying the one or more fluid flow parameters; and controlling the downhole tool responsive to the detected temperature response.

Example 2

The method of Example 1, wherein varying the one or more fluid flow parameters comprises varying a flow rate of the fluid flow.

Example 3

The method of any of Examples 1 to 2, further comprising: heating the fluid flow downhole in proximity to a temperature sensing location at which the temperature response is obtained.

Example 4

The method of any of Examples 1 to 3, wherein obtaining the temperature response comprises detecting a time-varying temperature change at a single temperature sensing location.

Example 5

The method of any of Examples 1 to 4, wherein obtaining the temperature response comprises sensing temperature at a first temperature sensing location, sensing temperature at a second temperature sensing location spaced from the first temperature sensing location, and detecting a time-varying temperature differential between the first and second temperature sensing locations.

Example 6

The method of any of Examples 1 to 5, wherein varying the one or more fluid flow parameters comprises varying a fluid composition of the fluid flow thereby varying a thermal conductivity of the fluid flow.

Example 7

The method of any of Examples 1 to 6, wherein encoding the tool control signal comprises encoding a digital "1" by controlling the fluid flow parameters to within a first value range and encoding a digital "0" by controlling the fluid flow parameters to within a second value range, wherein the first and second value range are distinguishable based on the detected temperature response.

Example 8

The method of any of Examples 1 to 7, wherein controlling the downhole tool comprises: electronically signaling a tool actuator coupled to the downhole tool in response to the tool control signal; and powering the tool actuator with a power source coupled to the tool actuator to activate the downhole tool.

Example 9

The method of any of Examples 1 to 8, wherein controlling the downhole tool comprises: adjusting a variable flow restriction in response to the tool control signal; and using a pressure change resulting from adjusting the variable flow restriction to activate or deactivate the downhole tool.

Example 10

The method of any of Examples 1 to 9, further comprising: conveying the fluid flow down the well through a tubular conveyance; obtaining the temperature response at an insert positioned along the tubular conveyance, the insert defining a flow passage for passing the fluid flow through the insert; dropping a plugging member down the well and through the flow passage of the insert to a second downhole tool; and plugging a tool flow bore of the second downhole tool with the plugging member.

Example 11

A system for controlling a downhole tool, comprising: a signal transmitter comprising a signal encoder that encodes a tool control signal by varying one or more fluid flow parameters of a fluid flow down a well; a signal receiver positionable in the well in fluid communication with the fluid flow, the signal receiver detecting a temperature response in the fluid flow resulting from varying the one or more fluid flow parameters; and a controller for controlling the downhole tool according to the temperature response.

Example 12

The system of Example 11, wherein the downhole tool comprises a variable flow restrictor and wherein the controller comprises an actuator for operating the variable flow restrictor.

Example 13

The system of Example 12, wherein the downhole tool further comprises: a tool component activated in response to a pressure increase from the actuator restricting flow through the variable flow restrictor.

Example 14

The system of any of Examples 11 to 13, wherein the signal receiver comprises an insert positionable inside a tubular conveyance that conveys the fluid flow down the well, the insert defining a flow passage for passing the fluid flow through the insert, with the calorimetric flow sensor coupled to the insert in fluid communication with the flow passage.

Example 15

The system of Example 14, wherein the flow passage of the insert further comprises a main bore having an inner diameter (ID) for passing a plugging member and an annular recess radially outwardly of the main bore, with one or both of a heating element and a temperature sensor positioned in the annular recess.

Example 16

The system of any of Examples 11 to 15, further comprising: a second downhole tool downstream of the flow insert having a tool flow bore and a seat for receiving a plugging member to close the tool flow bore, wherein the plugging member is sized to pass through the main bore of the insert to the second downhole tool to plug the tool flow bore.

Example 17

The system of any of Examples 11 to 16, wherein the calorimetric flow sensor comprises a heating element for heating the fluid flow downhole in proximity to a temperature sensing location at which the temperature response is obtained.

Example 18

The system of any of Examples 11 to 17, wherein the calorimetric flow sensor detects a time-varying temperature change at a single temperature sensing location.

Example 19

The system of any of Examples 11 to 18, wherein the calorimetric flow sensor senses temperature at a first temperature sensing location and at a second temperature sensing location spaced from the first temperature sensing location, and detects a temperature variation as a time-varying temperature differential between the first and second temperature sensing locations.

Example 20

The system of any of Examples 11 to 19, wherein the controller interprets a first range of the temperature response as a digital "1" and interprets a second range of the temperature response as a digital "0".

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method of controlling a downhole tool, comprising:

encoding a tool control signal in a fluid flow down a well by varying one or more fluid flow parameters of the fluid flow, wherein varying the one or more fluid flow parameters comprises varying a fluid composition of the fluid flow thereby varying thermal conductivity of the fluid flow;

sensing a temperature response downhole resulting from varying the one or more fluid flow parameters using a calorimetric sensor;

interpreting the tool control signal according to the temperature response; and actuating the downhole tool in response to interpreting the tool control signal.

2. The method of claim 1, wherein varying the one or more fluid flow parameters comprises varying a flow rate of the fluid flow.

3. The method of claim 1, further comprising:

heating the fluid flow downhole in proximity to a temperature sensing location at which the temperature response is obtained.

4. The method of claim 1, wherein obtaining the temperature response comprises detecting a time-varying temperature change at a single temperature sensing location.

5. The method of claim 1, wherein obtaining the temperature response comprises sensing temperature at a first temperature sensing location, sensing temperature at a second temperature sensing location spaced from the first temperature sensing location, and detecting a time-varying temperature differential between the first and second temperature sensing locations.

6. The method of claim 1, wherein encoding the tool control signal comprises encoding a digital "1" by controlling the fluid flow parameters to within a first value range and encoding a digital "0" by controlling the fluid flow parameters to within a second value range, wherein the first and second value range are distinguishable based on the temperature response.

7. The method of claim 1, wherein controlling the downhole tool comprises:

electronically signaling a tool actuator coupled to the downhole tool in response to the tool control signal; and powering the tool actuator with a power source coupled to the tool actuator to activate the downhole tool.

8. The method of claim 1, wherein controlling the downhole tool comprises:

adjusting a variable flow restriction in response to the tool control signal; and using a pressure change resulting from adjusting the variable flow restriction to activate or deactivate the downhole tool.

9. The method of claim 1, further comprising:

conveying the fluid flow down the well through a tubular conveyance;

obtaining the temperature response at an insert positioned along the tubular conveyance, the insert defining a flow passage for passing the fluid flow through the insert;

dropping a plugging member down the well and through the flow passage of the insert to a second downhole tool; and plugging a tool flow bore of the second downhole tool with the plugging member.

10. A system for controlling a downhole tool, comprising:

a signal transmitter comprising a signal encoder that encodes a tool control signal by varying one or more fluid flow parameters of a fluid flow down a well, wherein varying the one or more fluid flow parameters comprises varying a fluid composition of the fluid flow thereby varying a thermal conductivity of the fluid flow;

a signal receiver positionable in the well in fluid communication with the fluid flow, the signal receiver comprising a calorimetric sensor to detect a temperature response in the fluid flow resulting from varying the one or more fluid flow parameters;

a controller configured to interpret the tool control signal according to the temperature response and initiate actuation of the downhole tool in response to interpreting the tool control signal.

11. The system of claim 10, wherein the downhole tool comprises a variable flow restrictor and wherein the controller comprises an actuator for operating the variable flow restrictor.

12. The system of claim 11, wherein the downhole tool further comprises:

a tool component activated in response to a pressure increase from the actuator restricting flow through the variable flow restrictor.

13. The system of claim 10, wherein the signal receiver comprises an insert positionable inside a tubular conveyance that conveys the fluid flow down the well, the insert defining a flow passage for passing the fluid flow through the insert, with the calorimetric sensor coupled to the insert in fluid communication with the flow passage.

14. The system of claim 13, wherein the flow passage of the insert further comprises a main bore having an inner diameter (ID) for passing a plugging member and an annular recess radially outwardly of the main bore, with one or both of a heating element and a temperature sensor positioned in the annular recess.

15. The system of claim 13, further comprising:

a second downhole tool downstream of the insert having a tool flow bore and a seat for receiving a plugging member to close the tool flow bore, wherein the plugging member is sized to pass through the flow passage of the insert to the second downhole tool to plug the tool flow bore.

16. The system of claim 10, wherein the calorimetric sensor comprises a calorimetric flow sensor including a heating element for heating the fluid flow downhole and a temperature sensor at a temperature sensing location for obtaining the temperature response.

17. The system of claim 16, wherein the calorimetric flow sensor detects a time-varying temperature change at a single temperature sensing location.

18. The system of claim 16, wherein the calorimetric flow sensor senses temperature at a first temperature sensing location and at a second temperature sensing location spaced from the first temperature sensing location, and detects a temperature variation as a time-varying temperature differential between the first and second temperature sensing locations.

19. The system of claim 10, wherein the controller interprets a first range of the temperature response as a digital "1" and interprets a second range of the temperature response as a digital "0".

* * * * *